US010375795B2

(12) United States Patent
Davis et al.

(10) Patent No.: US 10,375,795 B2
(45) Date of Patent: Aug. 6, 2019

(54) POWERING AN AUXILIARY CIRCUIT ASSOCIATED WITH A LUMINAIRE

(71) Applicant: ABL IP Holding LLC, Decatur, GA (US)

(72) Inventors: Yelena N. Davis, Worthington, OH (US); Yaser S. Abdelsamed, Granville, OH (US); Candace Wilson, Decatur, GA (US)

(73) Assignee: ABL IP Holding LLC, Atlanta, GA (US)

( * ) Notice: Subject to any disclaimer, the term of this patent is extended or adjusted under 35 U.S.C. 154(b) by 135 days.

(21) Appl. No.: 15/605,002

(22) Filed: May 25, 2017

(65) Prior Publication Data

US 2017/0346387 A1 Nov. 30, 2017

Related U.S. Application Data

(60) Provisional application No. 62/342,272, filed on May 27, 2016.

(51) Int. Cl.

| | |
|---|---|
| ***H05B 33/08*** | (2006.01) |
| ***H05B 35/00*** | (2006.01) |
| ***H05B 41/36*** | (2006.01) |

(52) U.S. Cl.

CPC ..... *H05B 35/00* (2013.01); *H05B 33/0842* (2013.01); *H05B 41/36* (2013.01)

(58) Field of Classification Search

CPC .... H05B 33/0842; H05B 35/00; H05B 41/36; H02M 1/32

USPC ..... 307/35

See application file for complete search history.

(56) References Cited

U.S. PATENT DOCUMENTS

| | | | | |
|---|---|---|---|---|
| 6,335,575 | B1 | 1/2002 | Reutlinger et al. | |
| 9,167,651 | B2 | 10/2015 | Roberts | |
| 2010/0141162 | A1 | 6/2010 | Matsumoto et al. | |
| 2010/0181923 | A1 | 7/2010 | Hoogzaad | |
| 2012/0112657 | A1 | 5/2012 | Van Der Veen et al. | |
| 2012/0146544 | A1 | 6/2012 | Sauerlaender et al. | |
| 2012/0319612 | A1 | 12/2012 | Weil et al. | |
| 2013/0015774 | A1* | 1/2013 | Briggs | H05B 33/0815 315/186 |
| 2013/0038242 | A1 | 2/2013 | Athalye | |
| 2015/0022087 | A1 | 1/2015 | Brnada | |
| 2015/0327339 | A1 | 11/2015 | Melanson et al. | |

* cited by examiner

*Primary Examiner* — Hal Kaplan

(74) *Attorney, Agent, or Firm* — Kilpatrick Townsend & Stockton LLP

(57) ABSTRACT

An auxiliary power system for powering an auxiliary circuit is connected to the same power source that powers the lighting element within a luminaire. The auxiliary power system may be connected to the output of the power source in series or in parallel with the lighting element. The power source may be an LED driver and the lighting element may include one or more LEDs or the power source may be an electronic ballast and the lighting element may be one or more fluorescent lamps.

23 Claims, 9 Drawing Sheets

POWERING AN AUXILIARY CIRCUIT ASSOCIATED WITH A LUMINAIRE

RELATED APPLICATION

This application claims priority to U.S. Ser. No. 62/342,272 filed May 27, 2016 entitled Auxiliary Power Supply from Output of LED Driver, which is incorporated herein in its entirety by reference.

TECHNICAL FIELD

The present invention is generally directed to providing power to an auxiliary circuit and more specifically to using power from a power source for powering a lighting element to power the auxiliary circuit.

BACKGROUND

A luminaire, such as those that use light-emitting diodes (LEDs) or fluorescent lamps, may include auxiliary devices, such as occupancy sensors or wireless communication modules. Some luminaries provide power to an auxiliary device through a dedicated power source that is separate from the power source that powers the lighting element within the luminaire. Other luminaries provide power to an auxiliary device by connecting the device to a point between LEDs within an LED string. This approach provides a fixed voltage to the auxiliary device based on the position of the connection within the string of LEDs. Since the LEDs in the string and the position of the connection are predetermined, this configuration limits the voltage available to the auxiliary device and thus, limits the type of auxiliary device that may be connected. Additionally, this approach requires a dedicated LED module with an LED string accessible through an external connection, which further limits the use of this approach in luminaire applications.

SUMMARY

An auxiliary power system provides power to an auxiliary circuit. The auxiliary power system is connected to the same power source that powers the lighting element. The auxiliary power system may be connected to the output of the power source in series or in parallel with the lighting element. The power source may be an LED driver and the lighting element may include one or more LEDs or the power source may be an electronic ballast and the lighting element may be one or more fluorescent lamps.

When the auxiliary power system is connected to the power source in parallel with the lighting element, one end of the lighting element is connected to the positive output of the power source and the other end of the lighting element is connected to the negative output of the power source. A voltage regulation circuit is connected to the positive and negative outputs of the power source in parallel with the lighting element. The voltage regulation circuit provides power to an auxiliary circuit and may be configured as a step-up or step-down, linear or switching converter.

When the auxiliary power system is connected to the power source in series with the lighting element, a shunt component is connected in series with the lighting element and the voltage regulation circuit is connected in parallel to the shunt component. The voltage regulation circuit may be configured as a step-up or step-down, linear or switching converter. The shunt component may be connected to the positive or negative output of the power source, depending on the type of the auxiliary circuit. Exemplary shunt components include a diode, a resistor, or a Zener diode.

When the shunt component is connected to the negative output of the power source, one end of the lighting element is connected to the positive output of the power source and the other end of the lighting element is connected to one terminal of the shunt component. The other terminal of the shunt component is connected to the negative output of the power source.

When the shunt component is connected to the positive output of the power source, one end of the lighting element is connected to the negative output of the power source and the other end of the lighting element is connected to one terminal of the shunt component. The other terminal of the shunt component is connected to the positive output of the power source.

These illustrative aspects and features are mentioned not to limit or define the invention, but to provide examples to aid understanding of the inventive concepts disclosed in this application. Other aspects, advantages, and features of the present invention will become apparent after review of the entire application.

DETAILED DESCRIPTION

The present invention provides an auxiliary power system for powering an auxiliary circuit. The auxiliary power system is connected to the same power source that powers the lighting element. The auxiliary power system may be connected to the output of the power source in series or in parallel with the lighting element. The power source may be an LED driver and the lighting element may include one or more LEDs or the power source may be an electronic ballast and the lighting element may be one or more fluorescent lamps.

Auxiliary Power System Connected in Parallel

Figure 1:
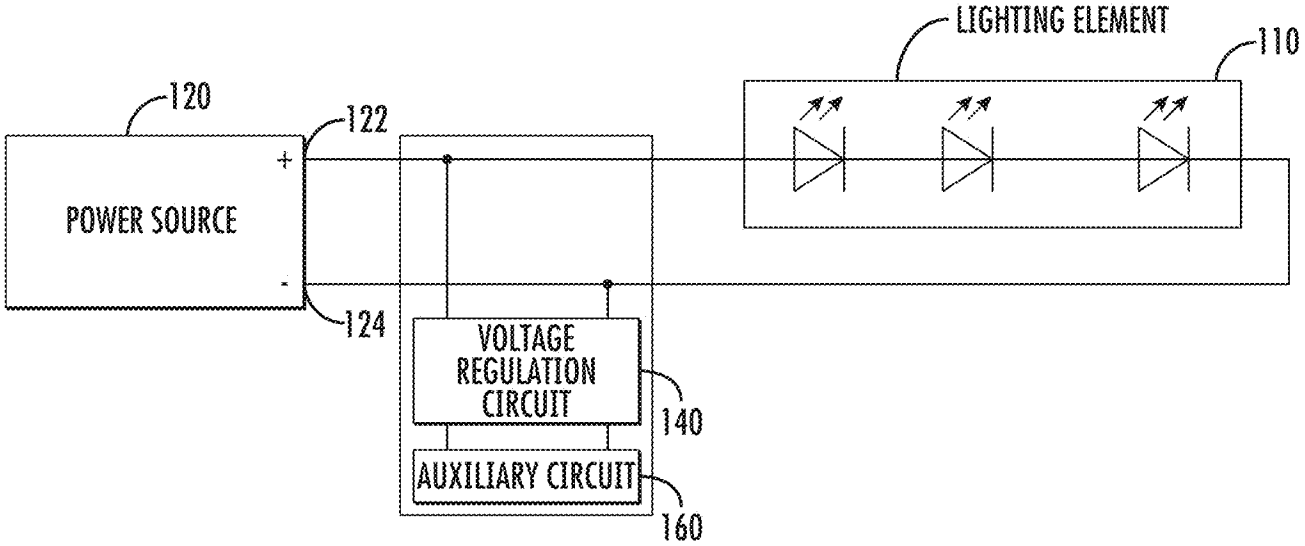
FIG. 1 is a block diagram of a portion of a luminaire having a voltage regulation circuit connected in parallel with a lighting element, in accordance with an exemplary implementation.

In some examples, the auxiliary power system is connected to the power source in parallel with the lighting element. FIG. 1 illustrates a portion of a luminaire that includes a power source 120, a lighting element 110, a voltage regulation circuit 140, and an auxiliary circuit 160. One end of the lighting element is connected to the positive output 122 of the power source and the other end of the lighting element is connected to the negative output 124 of the power source. The voltage regulation circuit 140 is connected to the positive and negative outputs of the power source in parallel with the lighting element. The voltage regulation circuit 140 provides power to an auxiliary circuit 160. The auxiliary circuit may include a sensor, a transceiver, or other device.

Figure 2:
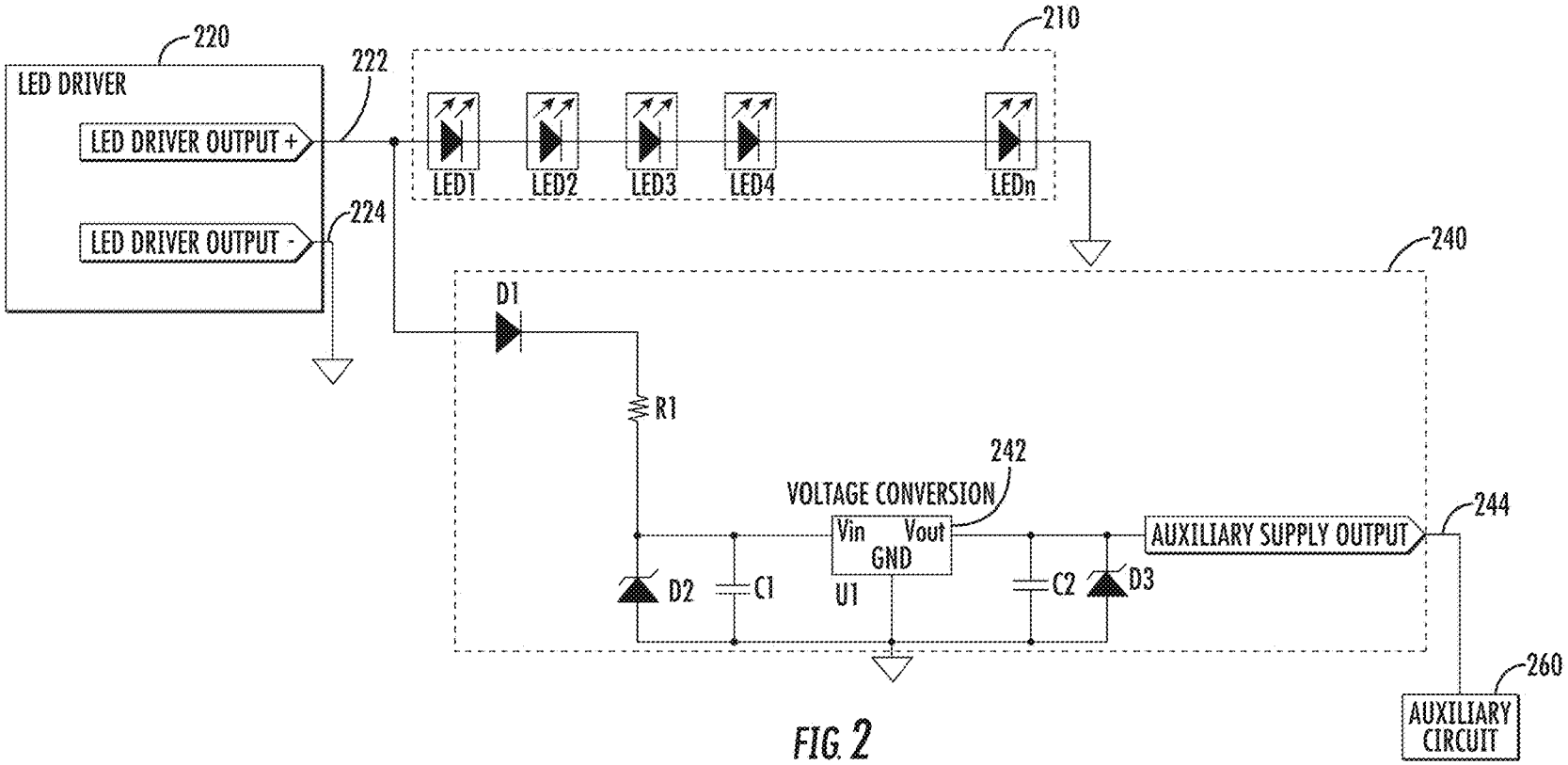
FIG. 2 is a block diagram of a portion of a luminaire having a voltage regulation circuit connected in parallel with an LED lighting element, in accordance with a exemplary implementation.

FIG. 2 illustrates one example where the power source is an LED driver 220 and the lighting element 210 includes one or more LEDs. One end of the LED lighting element is connected to the positive output 222 of the LED driver and the other end of the LEDs is connected to digital ground. The negative output 224 of the LED driver is also connected to digital ground. The voltage regulation circuit 240 is connected to the positive output of the LED driver and to digital ground in parallel with the LED lighting element 210. The voltage regulation circuit 240 provides power to an auxiliary circuit 260 via output 244.

The voltage regulation circuit 240 of FIG. 2 includes a voltage conversion module 242. The voltage conversion module converts an input voltage (Vin) to an output voltage (Vout). In one implementation, the voltage conversion module is a linear voltage-regulating IC, but other types of voltage conversion modules may be used, including switching regulator IC's and implementations using discrete components.

The voltage regulation circuit 240 includes a diode D1 and a resistor R1, connected in series between the positive output 222 of the LED driver and the voltage input pin of the voltage conversion module 242. The diode D1 can operate as a reverse voltage blocker and protect the LED driver 220 and the LEDs 210 from voltage spikes generated by the auxiliary circuit. The resistor R1 can operate as a current limiter and limit the amount of current transferred to the auxiliary circuit. Since if the auxiliary circuit draws too much current, the operation of the LED driver or LED lighting element may be adversely affected. The value of R1 can be based on the current needs of the auxiliary circuit 260, the current needs of the LED lighting element 210, or the current needs of both.

The voltage regulation circuit may also include capacitor C2 and Zener diode D3, connected in parallel between the Vout pin of the voltage conversion module and digital ground. The Zener diode D3 can protect the auxiliary circuit from transient voltage spikes generated by the LED driver 220 or voltage regulation circuit 240.

In one exemplary implementation of FIG. 2 where the LED driver 220 has a maximum output voltage of 40 VDC and the auxiliary output 244 has a nominal voltage output of 15 VDC and a maximum current output of 4 mA the following component values are used. Diode D1 is a rectifier diode with a 100V reverse voltage rating. Resistor R1 has a value of 2.49 KΩ. Diode D2 is a Zener diode with a 24V rating. Capacitor C1 has a value of 0.33 μF. The voltage conversion module is a linear voltage regulator. Capacitor C2 has a value of 0.1 μF. Diode D3 is a Zener diode with a 17V rating. Other implementations, using other component selections and values, will be readily apparent to those skilled in the art.

Auxiliary Power System Connected in Series with LED Driver

In some examples, the auxiliary power system is connected to the power source in series with the lighting element. A shunt component is connected in series with the lighting element. The shunt component may be connected to the positive or negative output of the power source, depending on the type of the auxiliary circuit and the luminaire system configuration. For many luminaire applications, the shunt component is connected to the negative output of the power source. However, if the physical design of the luminaire requires a connection to the positive output of the power source, then the auxiliary circuit may require an electrically isolated output circuit and electrically isolated or wireless communication circuits. A voltage regulation circuit may be connected in parallel to the shunt component. In one implementation where the shunt component and the voltage regulation circuit are connected to the positive output of the power source, the digital ground of the voltage regulation circuit may be different from the digital ground of the power source and the lighting element.

Figure 3:
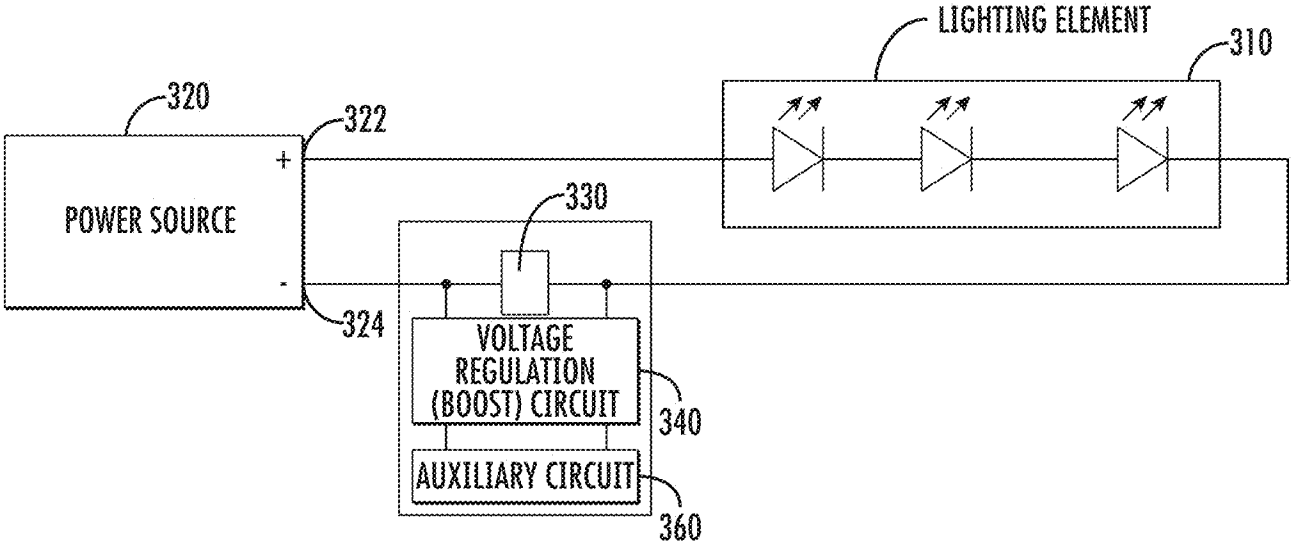
FIG. 3 is a block diagram of a portion of a luminaire having a shunt component connected in series with a lighting element, in accordance with an exemplary implementation.

FIG. 3 illustrates a portion of a luminaire that includes a power source 320, a lighting element 310, a shunt component 330, a voltage regulation circuit 340, and an auxiliary circuit 360. One end of the lighting element is connected to the positive output 322 of the power source and the other end of the lighting element is connected to one terminal of the shunt component 330. The other terminal of the shunt component 330 is connected to the negative output 324 of the power source. The shunt component 330 is connected to the power source in series with the lighting element 310. The voltage regulation circuit 340 is connected in parallel to the shunt component 330 and provides power to an auxiliary circuit 360.

The shunt component may be a diode, a resistor, a Zener diode, or a combination of these or other types of components. The voltage drop across the shunt component is provided to the voltage regulation circuit 340 as an input voltage. The voltage regulation circuit may be configured as a step-up or step-down, linear or switching converter.

Figure 4:
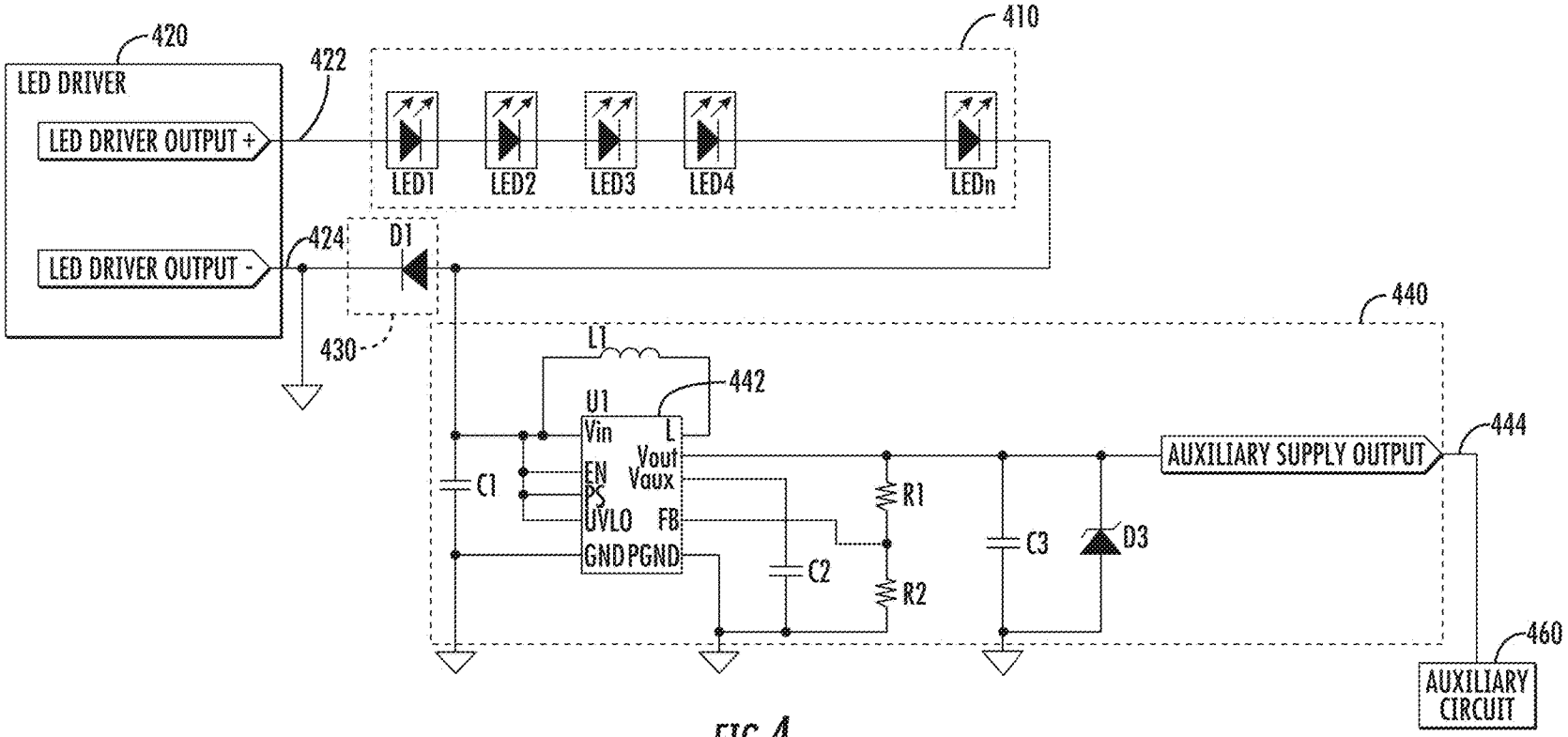
FIG. 4 is a block diagram of a portion of a luminaire having a shunt component connected in series with an LED lighting element, in accordance with an exemplary implementation.

In one example illustrated by FIG. 4, the power source is an LED driver 420, the lighting element 410 includes one or more LEDs, and the shunt component is a diode 430. One end of the LED lighting element is connected to the positive output 422 of the LED driver 420 and the other end of the LED lighting element is connected to the anode of diode D1. The cathode of diode D1 is connected to the negative output 424 of the LED driver, which may be digital ground. The voltage regulation circuit 440 is connected in parallel to diode D1. The voltage regulation circuit 440 provides power to an auxiliary circuit 460 via output 444.

The voltage regulation circuit 440 receives the voltage drop across the diode D1 as an input voltage. One benefit of using a diode as a shunt component is that a diode provides a more consistent voltage drop than some other possible shunt components. The voltage drop may be a fixed voltage based on the characteristics of the diode and thus may be independent of the voltage output from the LED driver.

The voltage regulation circuit 440 of FIG. 4 includes a voltage conversion module 442. The voltage conversion module converts an input voltage (Vin) to an output voltage (Vout). In one implementation, the voltage conversion module is a boost converter IC, such as the TP61202 IC provided by Texas Instruments, but other types of voltage conversion modules are possible, including those using discrete components.

The voltage regulation circuit 440 includes a capacitor C1 connected between the anode of the diode D1 and digital ground and an inductor L1 connected between the Vin and L pins of the voltage conversion module. It also includes a capacitor C2 connected between the Vaux pin and digital ground and resistors R1, R2. The resistors operate as a voltage divider and provide a feedback voltage to the FB pin of the voltage conversion module. The voltage regulation circuit 440 may also include capacitor C3 and Zener diode D3, connected in parallel between the Vout pin of the voltage conversion module and digital ground. The Zener diode D3 can protect the auxiliary circuit from transient voltage spikes generated by the LED driver 420 or voltage regulation circuit 440.

In one exemplary implementation of the configuration depicted in FIG. 4 where the LED driver 420 has a maximum output current of 3 A, and the auxiliary output 242 has a nominal voltage output of 3.3 VDC and a maximum current output of 75 mA, the following component values are used. D1 is a rectifier diode with a 600V reverse voltage rating. Capacitor C1 has a value of 10 μF, inductor L1 has a value of 2.2 resistor R1 has a value of 1 MΩ, resistor R2 has value of 180 KΩ, capacitor C2 has a value of 0.1 μF, capacitor C3 has a value of 10 μF, and D3 is a Zener diode with a 5V rating. Other implementations, using other component selections and values, will be readily apparent to those skilled in the art.

Figure 5:
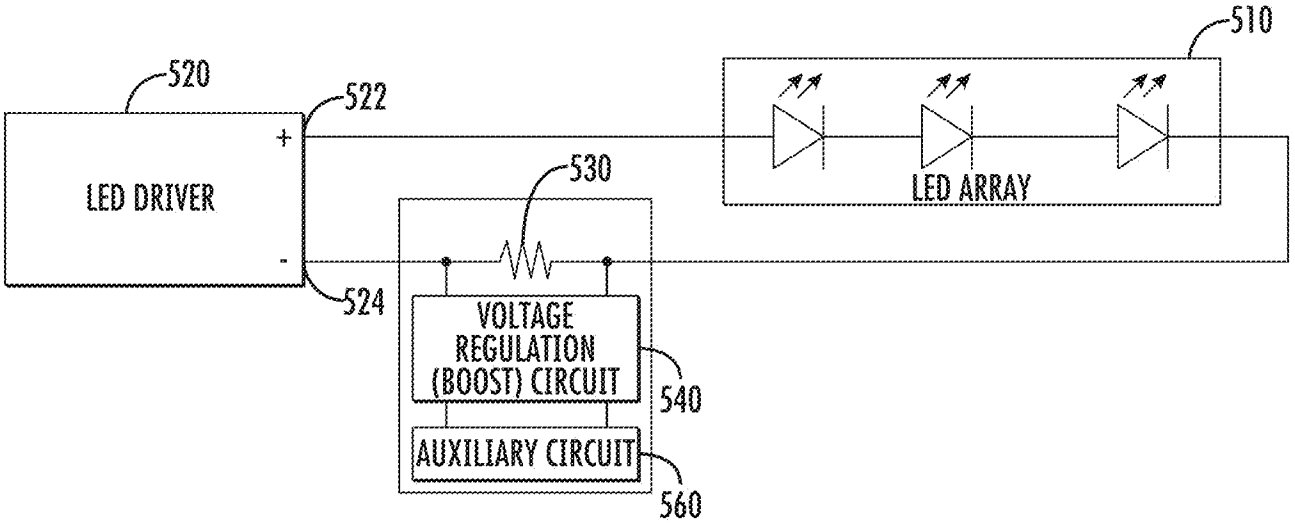
FIG. 5 is a block diagram of a portion of a luminaire having a shunt component connected in series with a lighting element, in accordance with an exemplary implementation.

The shunt component is not limited to a diode. FIG. 5 illustrates an example with a resistor 530 as the shunt component. The voltage drop across the resistor may be variable based on the output current level of the LED driver. FIG. 5 illustrates that the power source is an LED driver 520 and the lighting element 510 includes one or more LEDs. One end of the LED lighting element is connected to the positive output 522 of the LED driver 520 and the other end of the LED lighting element is connected to one terminal of the resistor 530. The other terminal of the resistor 530 is connected to the negative output 524 of the LED driver, which may be digital ground. The voltage regulation circuit 540 is connected in parallel to the resistor. The voltage regulation circuit 540 provides power to an auxiliary circuit 560. When the shunt component is a resistor, the component values of the components used in the voltage regulation circuit may depend upon the level of the voltage drop across the resistor.

Figure 6:
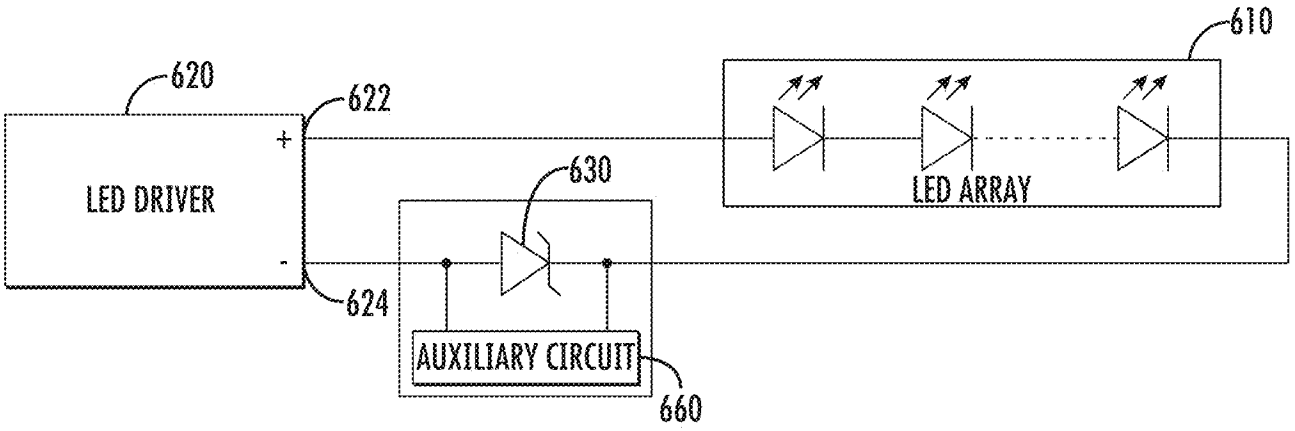
FIG. 6 is a block diagram of a portion of a luminaire having a shunt component connected in series with a lighting element, in accordance with an exemplary implementation.

FIG. 6 illustrates another implementation where the shunt component is a Zener diode 630, the power source is an LED driver 620, and the lighting element 610 includes one or more LEDs. One end of the LED lighting element is connected to the positive output 622 of the LED driver 620 and the other end of the LED lighting element is connected to the cathode of the Zener diode 630 The anode of the Zener diode 630 is connected to the negative output 624 of the LED driver, which may be digital ground.

The voltage drop across the Zener diode provides power to auxiliary circuit 660. The voltage drop across the Zener diode may be a fixed voltage based on the characteristics of the Zener diode. The Zener diode may be connected directly to the auxiliary circuit. The auxiliary circuit 660 may be connected in parallel to the Zener diode, as shown in FIG. 6. Alternatively, a voltage regulation circuit (not shown) may be connected in parallel to the Zener diode and an output of the voltage regulation circuit may power the auxiliary circuit. When the shunt component is a Zener diode, the component values of the components used in the voltage regulation circuit may depend upon the level of the voltage drop across the Zener diode.

Although FIGS. 2-6 illustrate a lighting element with a string of LEDs connected in series, the lighting element may include LEDs arranged in series, in parallel, or in any combination thereof.

Figure 7:
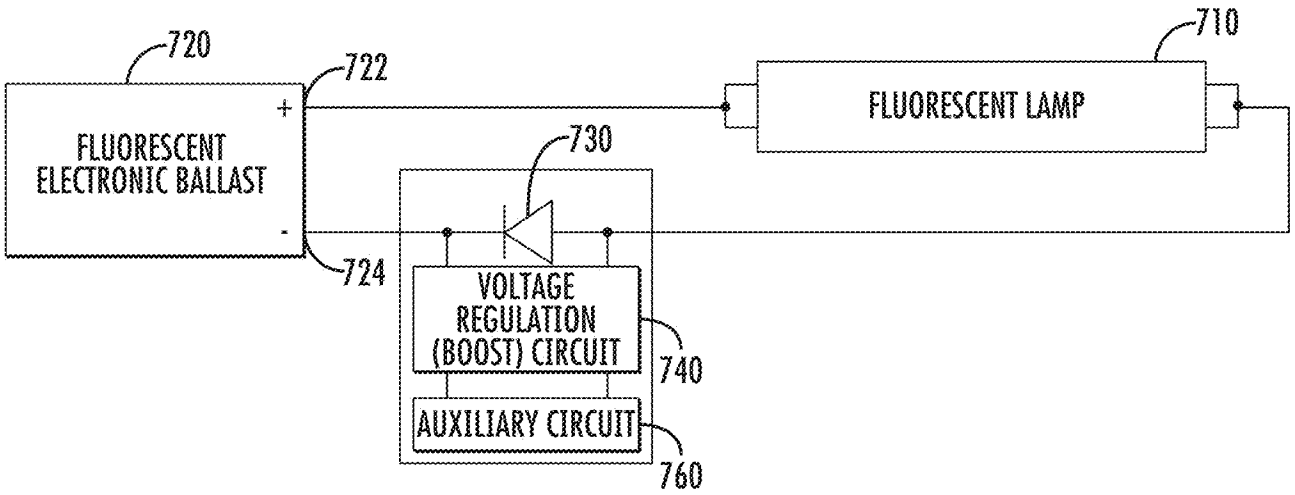
FIG. 7 is a block diagram of a portion of a luminaire having a shunt component connected in series with a fluorescent lighting element, in accordance with an exemplary implementation.

The auxiliary power system is not limited to implementations where the power source is an LED driver and the lighting element is an LED lighting element. The power source may be an electronic ballast and the lighting element may be one or more fluorescent lamps. FIG. 7 illustrates one example of an auxiliary power system that operates in a luminaire that includes an electronic ballast 720 and a fluorescent lamp 710. The luminaire illustrated in FIG. 7 also includes a diode as the shunt component 730, a voltage regulation circuit 740, and an auxiliary circuit 760. One end of the fluorescent lamp is connected to the positive output 722 of the ballast and the other end of the fluorescent lamp is connected to the anode of the diode 730. The cathode of the shunt component 730 is connected to the negative output 724 of the ballast. The shunt component 730 is connected in series with the fluorescent lamp 710. The voltage regulation circuit 740 is connected in parallel to the shunt component 730 and provides power to an auxiliary circuit 760.

Figure 8:
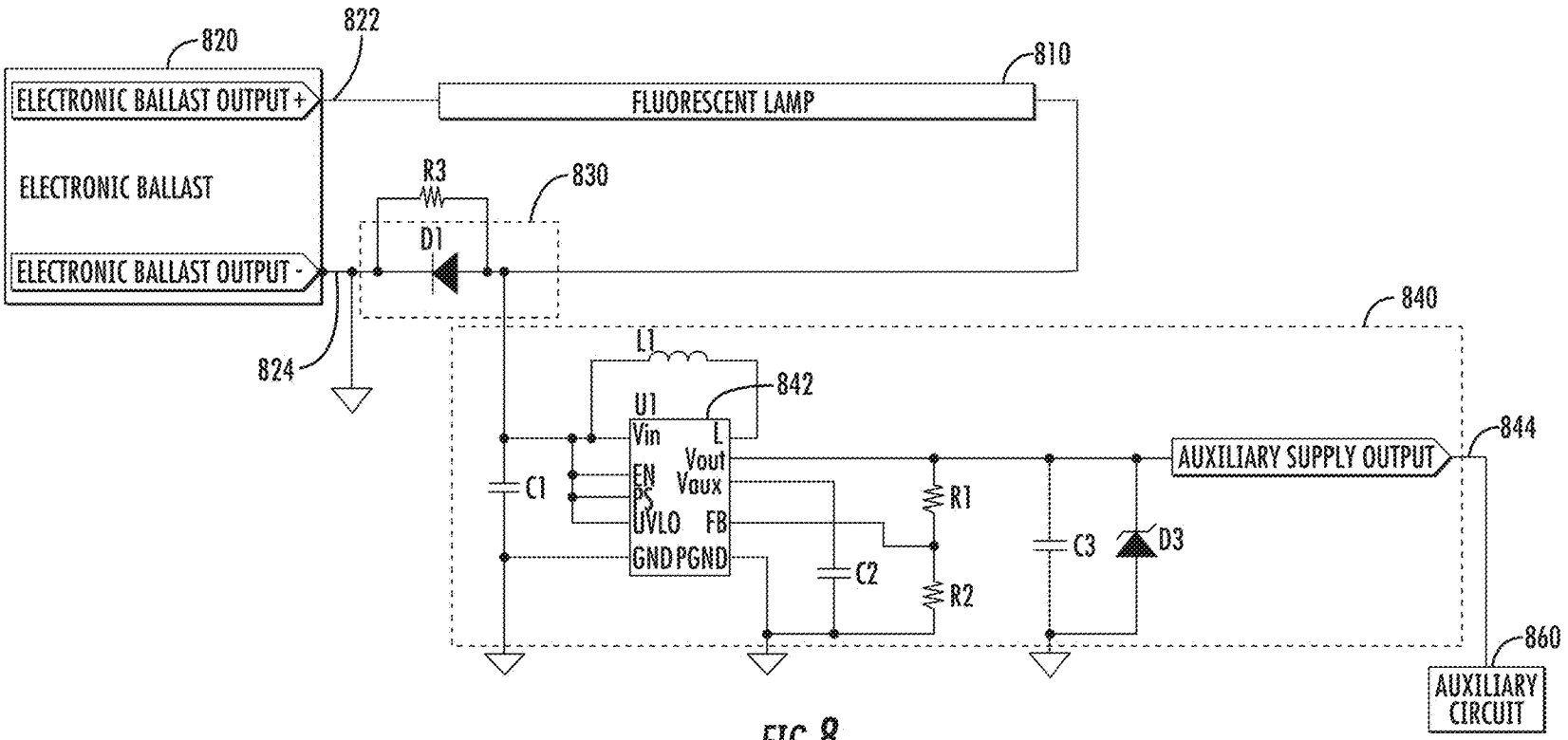
FIG. 8 is a block diagram of a portion of a luminaire having a shunt component connected in series with a fluorescent lighting element, in accordance with an exemplary implementation.

FIG. 8 illustrates additional details of an exemplary voltage regulation circuit. An optional resistor R3 may be connected in parallel to the diode D1 830 to prevent temporary polarity effects around the diode, which may occur if the ballast has a high initial open-circuit voltage to power the fluorescent lamp 810. The voltage regulation circuit 840 is connected in parallel to diode D1. The voltage regulation circuit 840 includes a capacitor C1 connected between the anode of the diode D1 and ground and an inductor L1 connected between the Vin pin and the L pin of the voltage conversion module 842. It also includes a capacitor C2 connected between the Vaux pin and ground and resistors R1, R2. The resistors operate as a voltage divider and provide a feedback voltage to the FB pin of the voltage conversion module 842. The voltage regulation circuit 840 may also include capacitor C3 and Zener diode D3, connected in parallel between the Vout pin of the voltage conversion module 842 and ground. An auxiliary supply output 844 of the voltage regulations circuit 840 may be connected to the auxiliary circuit 860. The Zener diode D3 can protect the auxiliary circuit 860 from transient voltage spikes generated by the ballast 820 or voltage regulation circuit 840. The ballast 820 may include an electronic ballast output with a positive terminal 822 and a negative terminal 824.

Figure 9:
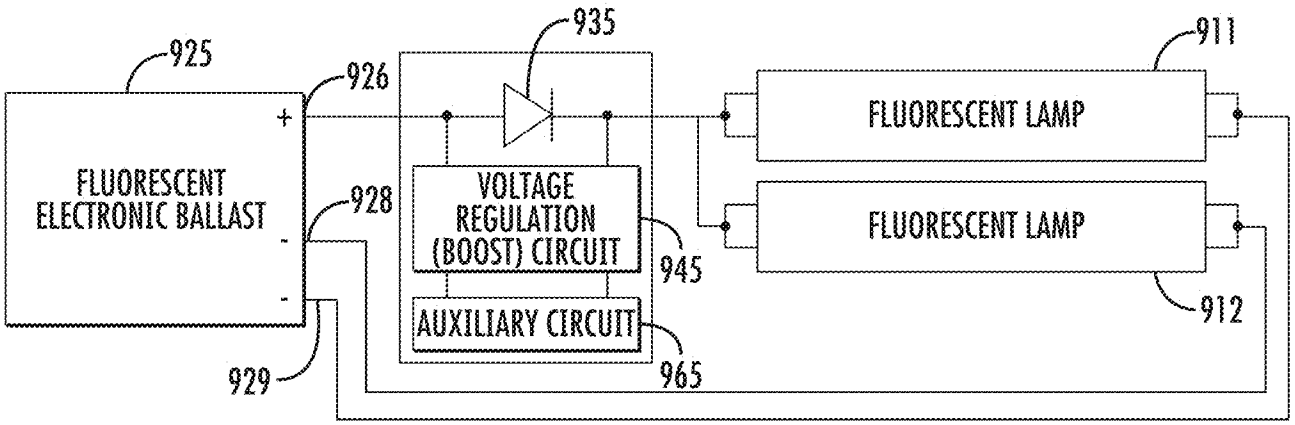
FIG. 9 is a block diagram of a portion of a luminaire having a shunt component connected in series with a fluorescent lighting element, in accordance with an exemplary implementation.

FIG. 9 illustrates another implementation where the shunt component 935 is positioned between the positive output 926 of the ballast 925 and the fluorescent lamps 911, 912. The other ends of the fluorescent lamps are connected to the negative outputs 928, 929 of the ballast. The shunt component 935 is a diode. The voltage regulation circuit 945 is connected in parallel to the shunt component and powers the auxiliary circuit 965. The implementation shown in FIG. 9 may be used with a ballast with two negative lamp connections.

The described auxiliary power circuits provide power to auxiliary devices or auxiliary circuits at minimum cost and complexity since they do not require a separate power source. In addition, the auxiliary power circuits provide design flexibility since the voltage regulation circuit may support different auxiliary devices with different power requirements. Although the foregoing describes the auxiliary circuit as including a sensor or a transceiver, the auxiliary circuit may contain other types of circuits and devices. The auxiliary circuit may be located within the same housing as the lighting element or may be located apart from the lighting element. In addition, the voltage regulation circuit and the auxiliary circuit are not required to be separate, but can be combined.

While the present subject matter has been described in detail with respect to specific aspects thereof, it will be appreciated that those skilled in the art, upon attaining an understanding of the foregoing, may readily produce alterations to, variations of, and equivalents to such aspects. Accordingly, it should be understood that the present disclosure has been presented for purposes of example rather than limitation and does not preclude inclusion of such modifications, variations, and/or additions to the present subject matter as would be readily apparent to one of ordinary skill in the art.

What is claimed is:

1. A luminaire, comprising:

an LED driver, having a first output and a second output;

an LED lighting element including at least one LED connected between the first output and the second output of the LED driver;

an auxiliary power system, wherein the auxiliary power system is connected between the first output and the second output of the LED driver and in parallel with the LED lighting element, wherein the auxiliary power system includes a voltage converter configured to convert an output voltage received from the LED driver to an auxiliary voltage, wherein the auxiliary voltage is independent of the output voltage received from the LED driver, and the auxiliary power system includes an output configured to provide the auxiliary voltage to an auxiliary device.

2. The luminaire of claim 1, wherein the auxiliary power system further comprises:

an input protection circuit connected between the first output of the LED driver and an input of the voltage converter, wherein the input protection circuit includes a current limiter for limiting an amount of current from the LED driver to the voltage converter and a voltage limiter for limiting a transient voltage from the LED driver to the voltage converter.

3. The luminaire of claim 2, wherein the current limiter includes a resistor connected in series between the first output of the LED driver and the input of the voltage converter.

4. The luminaire of claim 2, wherein the voltage limiter includes a Zener diode and a capacitor connected in parallel between the input of the voltage converter and digital ground.

5. The luminaire of claim 2, wherein the input protection circuit further includes a diode connected between the first output of the LED driver and the current limiter.

6. The luminaire of claim 1, further comprising:

an output protection circuit connected between an output of the voltage converter and the output of the auxiliary power circuit, wherein the output protection circuit includes a voltage limiter for preventing a transient voltage from the LED driver or the voltage converter to propagate to the output of the auxiliary power system.

7. The luminaire of claim 6, wherein the voltage limiter includes a Zener diode and a capacitor connected in parallel between the output of the voltage converter and digital ground.

8. The luminaire of claim 1, further comprising the auxiliary device.

9. An auxiliary power system, comprising:

an input configured to receive an output voltage from a first output of an LED driver;

a voltage converter configured to convert the output voltage from the LED driver to an auxiliary voltage, wherein the auxiliary voltage is independent of the output voltage received from the LED driver; and an output configured to provide the auxiliary voltage to an auxiliary device, wherein the auxiliary power system is configured for connection between the first output of the LED driver and a second output of the LED driver in parallel with an LED lighting element powered by the LED driver.

10. The system of claim 9, further comprising:

an input protection circuit connected between the input and an input of the voltage converter, wherein the input protection circuit includes a current limiter for limiting an amount of current from the LED driver to the voltage converter and a voltage limiter for limiting a transient voltage from the LED driver to the input of the voltage converter.

11. The system of claim 10, wherein the current limiter includes a resistor connected in series between the input and the input of the voltage converter.

12. The system of claim 10, wherein the voltage limiter includes a Zener diode and a capacitor connected in parallel between the input of the voltage converter and digital ground.

13. The system of claim 10, wherein the input protection circuit further includes a diode connected between the input and the current limiter.

14. The system of claim 9, further comprising:

an output protection circuit connected between an output of the voltage converter and the output, wherein the output protection circuit includes a voltage limiter for preventing a transient voltage from the LED driver or the voltage converter to propagate to the output of the auxiliary power system.

15. The system of claim 14, wherein the voltage limiter includes a Zener diode and a capacitor connected in parallel between the output of the voltage converter and digital ground.

16. The system of claim 9, wherein the voltage converter includes a step-up or step-down, linear or switching converter circuit.

17. An auxiliary power circuit, comprising:

a shunt component connected in series with a lighting device and a power source for powering the lighting device;

a voltage regulation circuit connected in parallel with the shunt component, wherein the voltage regulation circuit includes:

an input configured to receive an input voltage corresponding to a voltage drop across the shunt component;

a voltage converter configured to convert the input voltage to an auxiliary voltage, wherein the auxiliary voltage is independent of the input voltage; and an output configured to provide the auxiliary voltage to an auxiliary device.

18. The auxiliary power circuit of claim 17, wherein the lighting device includes a plurality of LEDs and the power source is an LED driver, and wherein a positive output of the LED driver is connected to a first connection point of the lighting device and the shunt component is connected between a second connection point of the lighting device and a negative output of the LED driver.

19. The auxiliary power circuit of claim 17, wherein the lighting device includes at least one fluorescent lamp and the power source is an electronic ballast.

20. The auxiliary power circuit of claim 17, wherein the shunt component includes at least one of a diode, a resistor, or a Zener diode.

21. The auxiliary power circuit of claim 17, wherein the voltage regulation circuit is configured as a step-up or step-down, linear or switching converter circuit.

22. The auxiliary power circuit of claim 17, wherein the voltage regulation circuit further includes a voltage limiter connected to an output of the voltage converter.

23. The auxiliary power circuit of claim 22, wherein the voltage limiter includes a Zener diode and a capacitor connected in parallel between the output of the voltage converter and ground.

* * * * *